US005387251A

United States Patent [19]

Rouse

[11] Patent Number: 5,387,251

[45] Date of Patent: Feb. 7, 1995

[54] ENDLESS BELT SANDING BLOCK

[76] Inventor: Evan D. Rouse, 31 Wildwood La., Perkinston, Miss. 39573

[21] Appl. No.: 237,006

[22] Filed: May 2, 1994

[51] Int. Cl.[6] ..... B24D 15/00

[52] U.S. Cl. ..... 451/513; 451/495; 451/499; 451/523

[58] Field of Search ..... 51/381, 382, 383, 363, 51/367, 391, 358, 372, 375, 357, 148, 392

[56] References Cited

U.S. PATENT DOCUMENTS

| | | | |
|---|---|---|---|
| 2,275,766 | 3/1942 | Johnson | 51/372 |
| 2,414,036 | 1/1947 | Gerhan | 51/391 |
| 2,470,615 | 5/1949 | Grover | 51/148 |
| 2,493,852 | 1/1950 | Bonkowski | 51/372 |
| 2,531,588 | 11/1950 | Stucker | 51/380 |
| 2,560,102 | 7/1951 | Guinn | 51/148 |
| 2,761,257 | 9/1956 | Mendelsohn | 51/372 |
| 3,063,208 | 11/1962 | Bell | 51/372 |
| 3,106,806 | 10/1963 | Hutchins | 51/372 |
| 3,429,077 | 2/1969 | Grover | 51/148 |
| 3,510,991 | 5/1970 | Bowen | 51/372 |
| 3,601,933 | 8/1971 | Bowen | 51/372 |
| 3,699,729 | 10/1972 | Garvey | 51/391 |
| 4,242,843 | 1/1981 | Phillips | 51/391 |
| 4,525,959 | 7/1985 | Ziebarth | 51/391 |
| 4,688,356 | 8/1987 | Madzgalla | 51/391 |
| 4,730,430 | 3/1988 | Petrovich | 51/387 |
| 5,172,524 | 12/1992 | Poss | 51/372 |

*Primary Examiner*—Robert A. Rose

[57] ABSTRACT

An improved endless belt sanding block, typically having four flat rigid support sections connected by a set of hinges (12), (16), (22), and (28) to form a foldable closed loop. Two of the support sections, an upper tapered support (18), and a lower tapered support (26), have thickened ends which hinge together at the inner surface of the foldable loop. A base support (10), typically the longest support section, and a top support (14), typically intermediate in length, complete the closed loop. When tapered supports (18) and (26) are folded inward at the juncture of their thick ends, the sanding block is in a contracted position and an endless sanding belt (32) may be placed around the outer surface of the sanding block. Conversely by folding outward, the thick ends pry outward against the endless sanding belt causing it to tighten. A brace section (24) inside the foldable loop connects to the same hinge used at the tapered supports juncture to form a triple hinge (22). After the endless sanding belt is tightened, brace section (24) is rotated about triple hinge (22) and brought into contact with a latch (30) located on the inner surface of base support (10). There it is held in the appropriate position to keep the endless sanding belt taut and ready for use.

20 Claims, 3 Drawing Sheets

ENDLESS BELT SANDING BLOCK

BACKGROUND—FIELD OF INVENTION

This invention relates to manually powered sanding devices, specifically to sanding blocks that use replaceable endless sanding belts.

BACKGROUND—DESCRIPTION OF PRIOR ART

The advantages of endless belt sanding blocks are well known. For instance the sanding belt can be repositioned on the block as necessary to utilize the entire sanding surface. Other advantages include the ease of swapping sanding surfaces and the superior quality of commercially available sanding belts as compared to sheet sandpaper.

Mounting the sanding belt is accomplished by first sliding it onto the sanding block; expanding the block until the belt tightens sufficiently; and then securing the block so that it maintains the desired expanded position. Based on prior known securing means, there are four types of endless belt sanding blocks: wedge, screw mechanism, resiliently urged, and opposed racks.

The wedge type is the simplest of the four U.S. Pat. No. 2,275,766 to Johnson (1942) is comprised of a block and a smaller wedge shaped section. The wedge section is wider than the width of the sanding belt. This allows for a full range of adjustment for size variations between belts. However, the protruding ends of the wedge interfere with the performance of the sanding block. Also the sanding belt support is uneven if the two parts aren't aligned carefully. U.S. Pat. No. 2,531,588 to Stucker (1950) uses two coplanar blocks with a wedge inserted between them. However the gap which is created between the blocks interupts the sanding belt support. Another problem with this device, and with Johnson's, is that when the belt is removed, the sanding block collapses into separate pieces. Improved sanding blocks U.S. Pat. Nos. 4,242,843 to Phillips (1981) and 4,525,959 to Ziebarth (1985) provide adequate sanding belt support and Phillips' device has provisions for preventing wedge detachment when the belt is removed.

Several types of sanding blocks use a screw mechanism to force apart two coplanar block members, thereby tightening the surrounding belt. U.S. Pat. No. 3,063,208 to Bell (1962) uses a complicated diagonal screw device, housed inside one of the block members to control a stud which forces the blocks apart. U.S. Pat. No. 3,510,991 to Bowen (1970) uses opposing cams between the coplanar members. The cams are connected by a bolt positioned transversely to the sanding block. Having oppositely spiraled threads, the bolt pulls together the cams as it is turned; this in turn forces apart the coplanar blocks. U.S. Pat. No. 3,601,933 also to Bowen (1971) uses two threaded studs located inside the sanding block. The studs are parallel to the sides of the block and are independently controlled by fluted nuts located between the two coplanar block members.

There are two variations of resiliently urged securing means for endless belt sanding blocks. One type, such as U.S. Pat. Nos. 2,493,852 to Bonkowski (1950); 2,761,257 to Mendelsohn (1956); 3,106,806 to Hutchins (1963); 4,730,430 to Petrovich (1988); and 5,172,524 to Poss (1992), uses one or more coil springs in conjunction with coplanar block members. The other type, represented by U.S. Pat. Nos. 3,699,729 to Garvey (1972), and 4,688,356 to Madzgalla, Hans-Georg (1987), uses a single bar of spring steel or elastomer, shaped so that it may be warped or bowed, then placed within a sanding belt to provide tension and support.

Only U.S. Pat. No. 2,414,036 to Gerhan (1947) uses opposed racks. The word rack in this case refers to a block of rigid or semi-rigid material with one side having the shape of a cog or tooth array along the length of one side. Opposing two similar racks and aligning them so their teeth interlock, produces the structural unit for the sanding block. The sanding block is elongated by unlocking the teeth; sliding the two blocks together in the appropriate direction; and then interlocking new pairs of teeth.

All heretofore known endless belt sanding blocks suffer from one or more of the following disadvantages:

(a) Problems with wedge securing means: The only wedges that are adequate for belt size variations either have excessive taper or protrude from the sides of the sanding block; wedges are at times difficult to remove and at other times tend to vibrate loose; when the sanding belt is removed, the wedge separates from the sanding block unless it has additional features to prevent this occurance; and the wedge tends to skew the sanding belt upon insertion.

(b) Screw mechanisms have sacrificed simplicity, low manufacturing cost and expedient operation for stability and improved adjustability.

(c) Resiliently urged securing means possess a number of undesirable traits: Care must be taken with both types of springs since they're only as stable as the strength of the spring being used; fluctuations in the size of endless belts causes different degrees of compression, resulting in variations in sanding block stability; strong springs improve the stability problem, but make changing belts excessively difficult; and with bar springs the sanding belt support tends to be warped when the sanding block is under pressure from the belt.

(d) The coplanar block members used in most of the sanding blocks present problems in themselves. As the coplanar members separate when tightening the sanding belt, a gap is created which interrupts the support for the belt. Additionally, the block members can fall apart when the belt is removed. Add-on pans designed to solve these problems also add undue complexity.

(e) The opposed rack sanding block also falls apart when the sanding belt is removed. There are additional problems: Because of poor handhold leverage, tightening the sanding belt is difficult; since the belt pressure is greater at the ends of the block, stability can be a problem; and loosening the belt is awkward because of the angle of the teeth.

OBJECTS AND ADVANTAGES

Accordingly, in addition to the well known advantages of all endless belt sanding blocks, objects and advantages of my sanding block are:

(a) to provide a sanding block with a fast and simple belt change operation;

(b) to provide a sanding block which allows the sanding belt to be stretched as tight as necessary to increase the efficiency of the sanding action and prevent excessive belt wear;

(c) to provide a sanding block with a shape that both enables it to sand in close to comers and allows it to be held comfortably with one or both hands;

(d) to provide a sanding block that works equally well with sanding belt variations in size, grade of abrasive, and flexibility;

(e) to provide a sanding block with multiple sections of firm, flat and uninterrupted sanding belt support;

(f) to provide a sanding block that tends to apply tension equally to the sides of the sanding belt;

(g) to provide a sanding block with a very sturdy yet lightweight internal structure;

(h) to provide a sanding block that is easily assembled from simple parts and is consequently inexpensive to manufacture;

(i) to provide a sanding block that does not separate or otherwise fall apart when the endless belt is removed;

Further objects and advantages are to provide a sanding block which can be constructed entirely out of one or more plastics or other inexpensive materials, and can be built to a wide variety of size and shape specifications without compromising any of it's important features. Still further objects and advantages will become apparent from a consideration of the ensuing description and drawings.

DRAWING FIGURES

Figure 2:
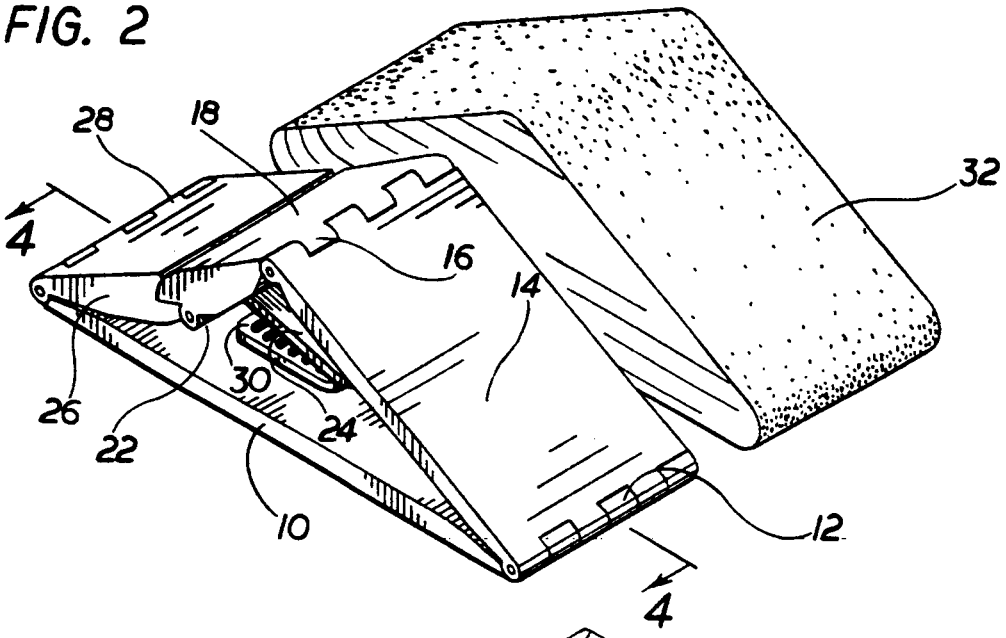
FIG. 2 shows an exploded isometric view of a sanding block held in contracted position and an endless sanding belt for mounting thereon.
Figure 4A:
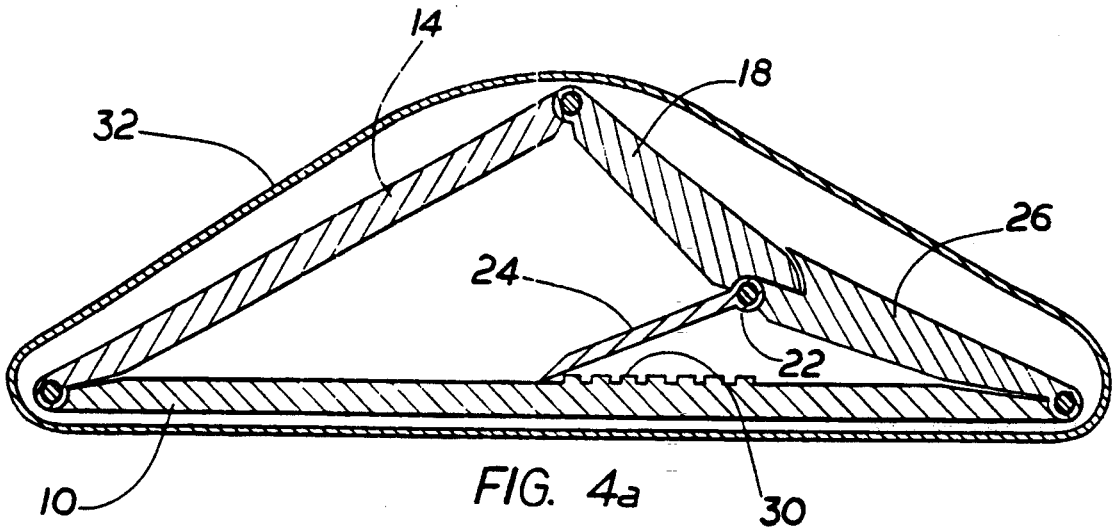
Figure 4B:
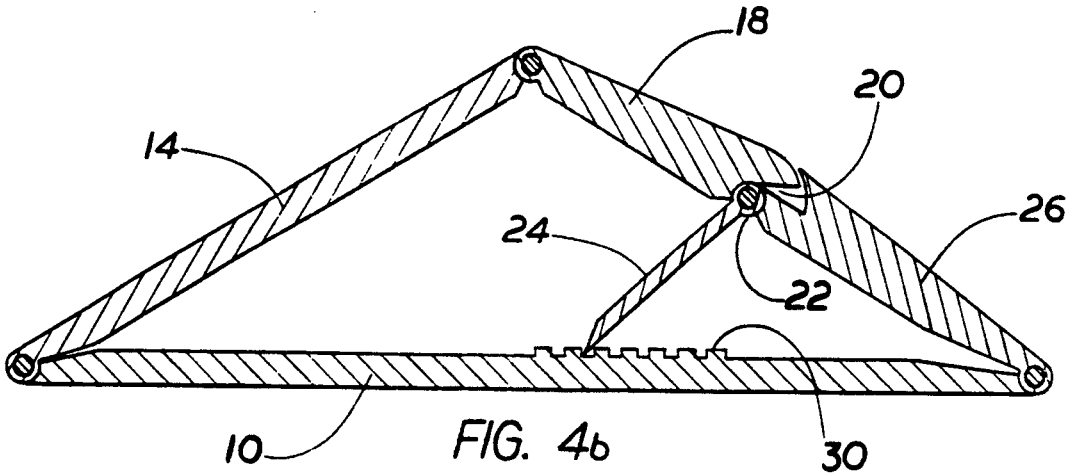
Figure 4C:
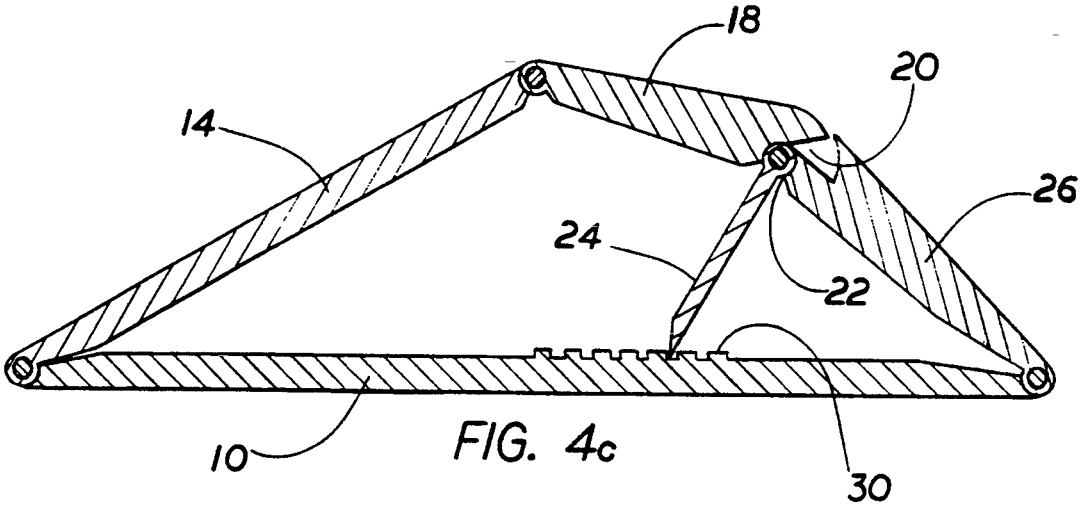

FIGS. 4*a*, 4*b*, and 4*c* show a cross sectional view taken on line 4—4 of FIG. 2, with sanding block adjusted to various positions.

Figure 5A:
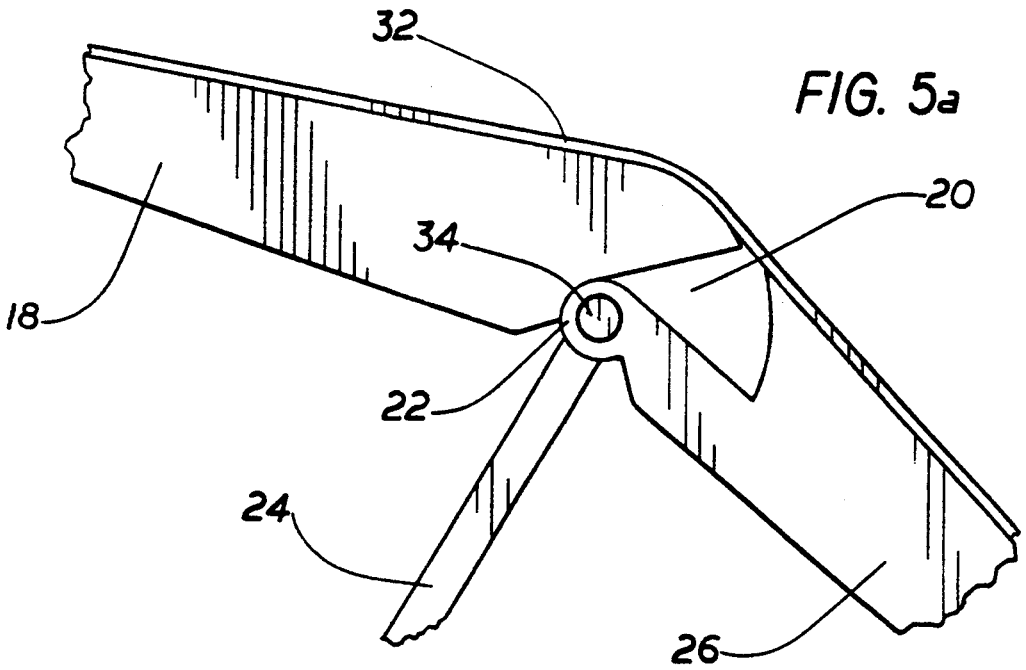
Figure 5B:
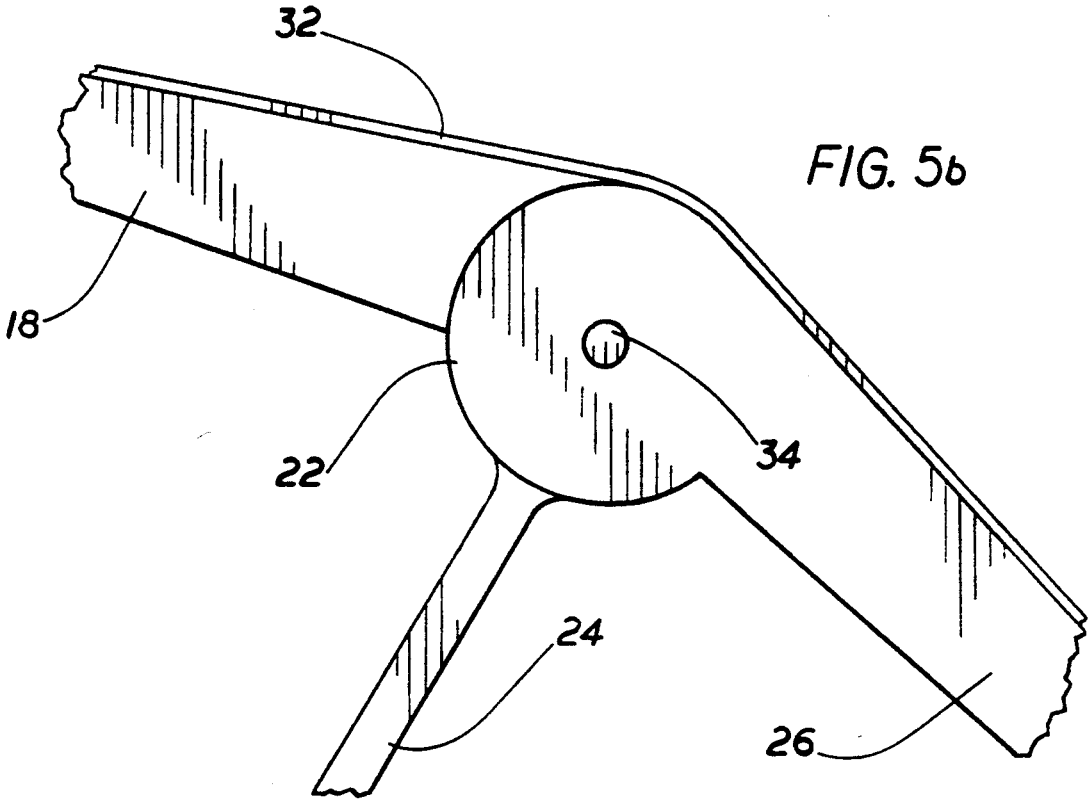

FIG. 5*a* shows in detail the profile of a small diameter triple hinge and FIG. 5*b* shows the same view with an alternative large diameter triple hinge.

REFERENCE NUMERALS IN DRAWINGS

10 base support
12 hinge
14 top support
16 hinge
18 upper tapered support
20 radial opening
22 triple hinge
24 brace
26 lower tapered support
28 hinge
30 latch
32 endless sanding belt
34 pivot pin

DESCRIPTION OF THE PREFERRED EMBODIMENTS

Figure 1:
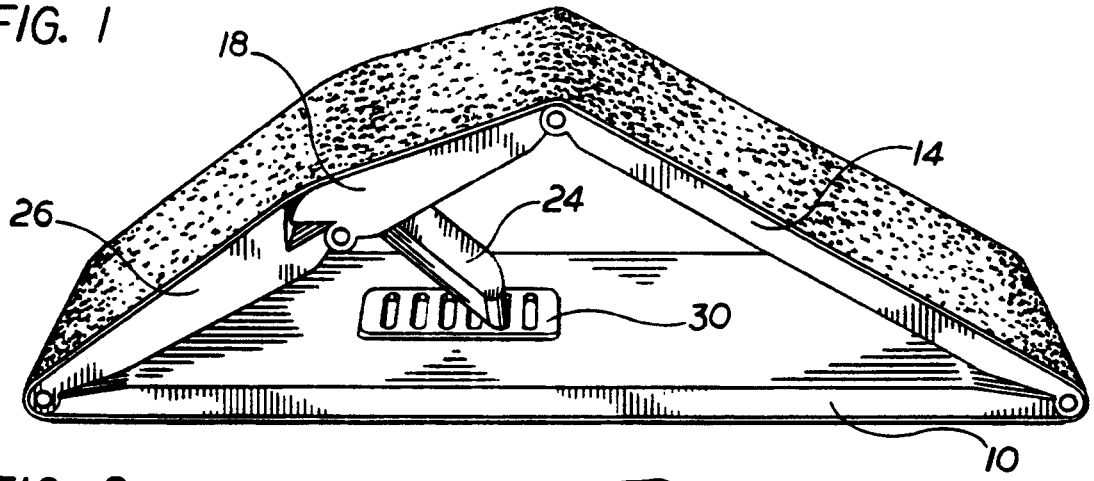
FIG. 1 shows a perspective view of a sanding block with mounted endless sanding belt.
Figure 3:
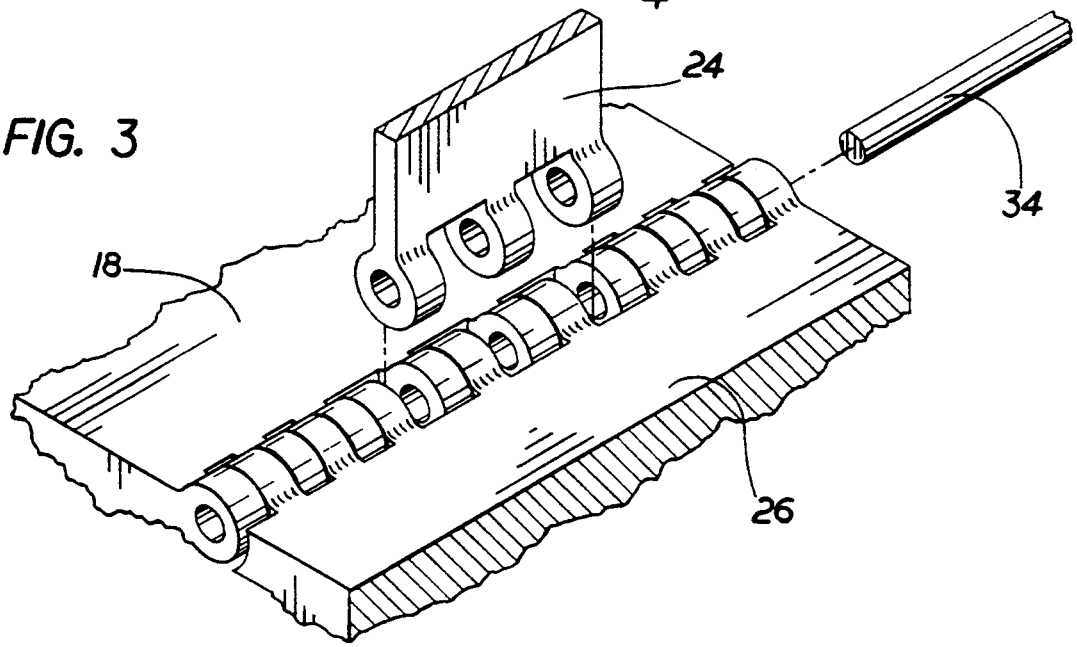
FIG. 3 shows an exploded isometric view of a triple hinge arrangement.

A perspective view of the sanding block, with a mounted endless sanding belt 32 is illustrated in FIG. 1. It is generally constructed as a foldable closed loop comprised of four supports having the same width as the sanding belt being used. A brace section 24 is connected to the inside of the loop. Referring to FIG. 2, a base support 10 is connected to a top support 14 by a hinge 12. Top support 14 is connected to an upper tapered support 18 by a hinge 16. Upper tapered support 18 is connected to brace 24 and a lower tapered support 26 by a triple hinge 22. To complete the loop, lower tapered support 26 is connected to base support 10 by a hinge 28. All hinges used are the conventional pivot pin variety. FIG. 3 shows an exploded view of one of many possible configurations for triple hinge 22. A pivot pin 34 fastens together brace 24, upper tapered support 18 and lower tapered support 26 when inserted as indicated. The other 3 hinges in the sanding block are simpler since each pin only connects 2 supports.

To provide adjustment of the sanding block, a portion of base support 10 has built in grooves to form a latch 30. Latch 30 is used to secure the free end of brace 24 in one of a number of positions as illustrated in FIGS. 4*a*, 4*b* and 4*c*. In FIG. 4*a* the sanding block is shown in the fully collapsed position. Brace 24 is extended past latch 30 and in this position sanding belt 32 is placed as indicated. FIG. 4*b* shows the latch position if a small sanding belt is mounted and FIG. 4*c* shows the position if a large belt is mounted. These figures also clearly show how tapered supports 18 and 26 are offset to the outside of triple hinge 22. As the sanding block is unfolded, upper and lower tapered supports 18 and 26 rotate outward about triple hinge 22. This causes the thick ends of tapered supports 18 and 26 to pry outward and effectively increase the perimeter of the sanding block, which in turn tightens sanding belt 32. When the sanding block has been unfolded to the desired belt tightness, the end of brace 24 is clicked into the appropriate latch 30 position, and is held in place by the taut belt. The result is a tensile structure which provides more than enough support for sanding by hand.

A resultant radial opening 20 is illustrated clearly in FIGS. 4*a*, 4*b*, and 4*c* and in a close-up view in FIG. 5*a*. By configuring it as shown, it doesn't significantly interfere with the sanding belt support. An alternative is to eliminate radial opening 20 by increasing the radius of triple hinge 22 beyond what would be the radius of radial opening 20, as illustrated in FIG. 5*b*.

Determination of the size, shape, and thickness of tapered supports 18 and 26 is affected by the following considerations:

The outer perimeter of the sanding block is at a minimum if the outer surfaces of tapered supports 18 and 26 are coplanar when the sanding block is in the collapsed position.

The relationship of outer perimeter increase of the sanding block to the degree the sanding block is unfolded depends upon the arc length induced by the radius of support surrounding triple hinge 22.

The range of size fluctuations between different brands and grits of endless sanding belts.

The adjustability of latch 30.

Although the sanding block is adjustable, this is only to allow tolerance for variations in belt circumference within a certain size classification, e.g. 76 mm×457 mm belts. Since there is a variety of commercially available sanding belt circumferences and widths, several sizes of sanding blocks may be made available. The sanding blocks can be mass produced with common manufacturing methods. By using plastic, each hinge and support can be molded as a solid unit. The hinges are the standard pivot pin variety so that final assembly of the sanding block merely requires meshing the ends of the supports and inserting tight fitting metal or plastic pins.

From the description above a number of advantages of my endless belt sanding block become evident:

(a) The open internal structure and the triangular shaped profile allows the sanding block to be held and manipulated easily with one or both hands in a variety of sanding situations.
(b) In certain cases it might be preferable to use one of the sanding block supports other than the base support for a working surface. This doesn't present a problem since the other support sections provide firm support, are uninterrupted, and unobstructed.
(c) When the sanding block is unfolded it applies tension equally to the sides of the sanding belt.
(d) The amount of material needed in the construction of this sanding block is minimal due to triangular structural bracing.
(e) Few parts and simple assembly indicate a product that is easily mass produced.
(f) At no time does the sanding block have a tendency to come apart, nor does it require any special additional parts to accomplish this feat.

OPERATION

Mounting and removing the sanding belt is a simple procedure. By pressing inward on triple hinge 22 while brace 24 is disengaged from latch 30, the sanding block may be brought to the collapsed position, as shown in FIGS. 2 and 4*a*. The sanding block may then be placed inside the sanding belt as indicated by the exploded view in FIG. 2. Once the belt is in position, triple hinge 22 is rotated outward and brace 24 is brought into contact with latch 30. FIG. 4*b* shows a cross section of the sanding block with brace 24 positioned in latch 30 for a small belt. FIG. 4*c* shows the latch position for a large belt.

There are several different ways to hold the sanding block during belt changing and adjustment. The following method is one of the simplest. First one's hand is placed inside the sanding block so that the fingertips straddle brace 24 and come to rest on the underside of tapered supports 18 and 26. With the thumb on top of sanding belt 32 near hinge 16, the end of the sanding block at hinge 28 is placed against a firm support. Positioned as such, the fingers can pry outward against triple hinge 22. As the sanding block unfolds, the other hand is used to bring brace 24 into contact with latch 30. When the desired belt tension is achieved, the end of brace 24 is clicked into the appropriate latch position. An alternative method is to use the palm of one's hand instead of a support. In which case brace 24 would be latched with the fingers of the other hand. Removing the belt is accomplished in similar fashion. By placing tension on the belt as described above, brace 24 can be rotated free of latch 30. The block is then folded, by pressing in on the sanding belt above triple hinge 22, to allow removal of the sanding belt.

Many of the previous sanding block designs use a resilient pad between the sanding belt and the structural support to help take up slack in the belt and help cover interruptions in the support. Although a resilient pad can be used with my sanding block, it would only be necessary for polishing purposes. For a planing action, for shaping parts, and for grinding down irregularities on a smooth surface without affecting the surrounding surface; the hard flat sanding surface provided by my sanding block is ideal.

From the description above, these advantages of my endless belt sanding block become evident:

(a) The speed at which the sanding block can be collapsed or expanded, and the use of the inherent resiliency of the belt to hold brace 24 against latch 30, greatly simplifies the belt change operation and re-positioning of the belt.
(b) The sanding block can be unfolded as necessary to increase tension on the belt, and is adjustable to account for variations between belts.
(c) The high quality of commercially available sanding belts, combined with the hardness of the fully tightened sanding surface which is possible with my sanding block, guarantees a superior hand manipulated tool for shaping and planing.

SUMMARY, RAMIFICATIONS, AND SCOPE

As the description shows, the endless belt sanding block of this invention provides a device that allows fast belt replacement, has a shape that can be held comfortably, and remains intact when the sanding belt is removed. To keep down manufacturing costs, it has simple parts which may be molded of plastic and quickly assembled. Furthermore, the folding loop structure has additional advantages in that it allows the sanding surface to be quickly stretched as tight as necessary thereby increasing efficiency and durability of the abrasive surface;
it compensates for sanding belt variations in size and flexibility without affecting the performance of the device;
it provides multiple sections of uninterpreted sanding belt support for increased effectiveness in certain applications;
it applies even tension over the surface of the sanding belt; and
it provides a structure that is lightweight yet with high strength, allowing a great deal of pressure to be applied to work surfaces.

While the above description contains many specificities, these should not be construed as limitations on the scope of the invention, but rather as an exemplification of one preferred embodiment thereof. Many other variations are possible. For example, with the appropriate clamping means, this device can be combined with a strip of flexible material so that a sheet of sandpaper or other abrasive material may be used to form an endless belt instead of using a typical commercial sanding belt; the supports can have shapes other than the flat ones described; and, the hinges can be constructed as flexible joints from any of a number of materials.

Accordingly, the scope of the invention should be determined not by the embodiments described, but by the appended claims and their legal equivalents.

I claim:

1. An endless belt sanding block comprising:

(a) a plurality of supports of sufficient width, combined length, and rigidity for supporting the width and circumference of an endless sanding belt;
(b) a plurality of hinge means for connecting said supports end to end so as to form a multiply sided closed loop which is foldable about said hinge means to a predetermined configuration suitable for placement inside said endless sanding belt;
(c) a leverage means located on the outer surface of said closed loop with the fulcrum at one of said hinge means wherein said leverage means begins prying outward against said endless belt after said closed loop is unfolded from a concave position to a convex position at the fulcrum of said leverage means; whereby the tension on said endless belt varies according to what degree the fulcrum is unfolded in the convex direction; and (d) a brace means for bracing one of said supports against another of said supports in order to secure said closed loop while said endless sanding belt is held under tension.

2. The endless belt sanding block of claim 1 wherein said multiply sided closed loop comprises:

(a) a base support which is the longest of said supports; it is the primary work surface and has an essentially uniform thickness;

(b) a top support approximately three fifths of the length of said base support, and of thickness comparable to that of said base support;

(c) two tapered supports, with approximately equal lengths which are about half the length of said top support; each with a thick end 2 to 3 times the thickness of said base support; and which taper from the thick ends, to respective thin ends with approximate thickness of said base support; and (d) said leverage means which comprises the thick ends of said tapered supports and a tapered supports hinge means which is one of said hinge means connecting the thick ends of said tapered supports so that the axis of rotation is positioned near the inner surface of said closed loop; whereby the thick ends provide a lever action and begin prying outward against said endless belt as said closed loop is unfolded from a concave position to a convex position at the juncture of said tapered supports.

3. The endless belt sanding block of claim 2 wherein said brace means comprises:

(a) a brace section one half to one third as wide, about half as thick, and constructed of the same material as said supports, and about three fourths as long as said tapered supports;

(b) a brace hinge means for connecting one end of said brace section to a position adjacent and parallel to the juncture of said tapered supports; whereby said brace section may rotate freely about an axis near said tapered supports hinge means;

(c) an adjustable latch means for fixing the free end of said brace section against the inner surface of said base support in one of various positions; whereby said brace means may account for fluctuations in said sanding belt size by holding said tapered supports unfolded the appropriate amount.

4. The endless belt sanding block of claim 3 wherein a triple hinge means, comprising said brace hinge means and said tapered supports hinge means, connects said brace section to the connection of said tapered supports.

5. The endless belt sanding block of claim 4 wherein each of said hinge means and said triple hinge means is a pin hinge comprising a pivot pin which defines the rotational axis of said pin hinge.

6. The endless belt sanding block of claim 5 wherein each said support and said brace section is attached to its respective pin hinge section by integrating the parts during a molding process using impact resistant plastic; whereby end to end connection is completed by inserting said pivot pins.

7. The endless belt sanding block of claim 6 wherein said adjustable latch means is comprised of a series of parallel grooves formed into the inner surface of said base support, with each of said grooves designed to accept the free end of said brace section and hold it there when under tension from said endless sanding belt.

8. An endless belt sanding block comprising:

(a) an endless abrasive belt;

(b) a plurality of supports of sufficient width, combined length, and rigidity for supporting the width and circumference of said endless abrasive belt;

(c) a plurality of hinge means for connecting said supports end to end so as to form a multiply sided closed loop which is foldable about said hinge means to a predetermined configuration suitable for placement inside said endless abrasive belt;

(d) a leverage means located on the outer part of said closed loop with the fulcrum at one of said hinge means wherein said leverage means begins prying outward against said abrasive belt after said closed loop is unfolded from a concave position to a convex position at the fulcrum of said leverage means; whereby the tension on said endless belt varies according to what degree the fulcrum is unfolded in the convex direction; and (e) a brace means for bracing one of said supports against another of said supports in order to secure said multiply sided closed loop while said endless abrasive belt is held under tension.

9. The endless belt sanding block of claim 8 wherein said multiply sided closed loop comprises:

(a) a base support which is the longest of said supports and has an essentially uniform thickness, (b) a top support approximately three fifths of the length of said base support, and of thickness comparable to that of said base support, (c) two tapered supports, with approximately equal lengths which are about half the length of said top support; each with a thick end 2 to 3 times the thickness of said base support; and which taper from the thick ends to respective thin ends with approximate thickness of said base support; and (d) said leverage means which comprises the thick ends of said tapered supports and a tapered supports hinge means which is one of said hinge means connecting the thick ends of said tapered supports so that the axis of rotation is essentially located at the intersection of the inner surfaces of said tapered supports; whereby the thick ends provide a lever action and begin prying outward against said endless abrasive belt as said closed loop is unfolded from a concave position to a convex position at the juncture of said tapered supports.

10. The endless belt sanding block of claim 9 wherein said brace means comprises:

(a) a brace section about half as thick as said supports, narrower than said supports, and about three fourths as long as said tapered supports;

(b) a brace hinge means for connecting one end of said brace section to a position adjacent and parallel to the juncture of said tapered supports; whereby said brace section may rotate freely about an axis near said tapered supports hinge means; and (c) an adjustable latch means for fixing the free end of said brace section against the inner surface of said base support in one of various positions; whereby said brace means may account for fluctuations in the size of said endless abrasive belt by holding said tapered supports unfolded the appropriate amount.

11. The endless belt sanding block of claim 10 wherein a triple hinge means, comprising said brace hinge means and said tapered supports hinge means, connects said brace section to the connection of said tapered supports.

12. The endless belt sanding block of claim 11 wherein said hinge means are pin hinges comprising a pivot pin which defines the rotational axis of said pin hinge.

13. The endless belt sanding block of claim 12 wherein each said support and said brace section is attached to its respective pin hinge section by integrating the parts during a molding process using impact resistant plastic; whereby end to end connection is completed by inserting said pivot pins.

14. The endless belt sanding block of claim 13 wherein said adjustable latch means is comprised of a series of parallel grooves formed into the inner surface of said base support, with each of said grooves designed to accept the free end of said brace section and hold it there when under tension from said endless abrasive belt.

15. In combination: a multiply sided closed loop comprising a plurality of foldable, suitably rigid supports connected end to end by a plurality of hinge means; collapsable to a predetermined folded position suitable for placement of an endless belt on the outer surface of said multiply sided closed loop; expandable by use of a leverage means located on the outside of said closed loop with the fulcrum at one of said hinge means wherein the tension on said endless belt varies according to what degree the fulcrum is unfolded in the convex configuration; and held in place by a brace means which secures said supports in proper relation to each other in order to maintain said endless belt in taut condition.

16. The invention of claim 15 wherein said multiply sided closed loop has a width equal to the width of said endless belt and comprises:

(a) a base support which is the longest of said supports; it is the primary work surface and has an essentially uniform thickness;

(b) a top support approximately three fifths of the length of said base support, and of thickness comparable to the thickness of said base support;

(c) two tapered supports, with approximately equal lengths which are about half the length of said top support; each with a thick end 2 to 3 times the thickness of said base support; and which taper from the thick ends, to respective thin ends with approximate thickness of said base support; and (d) said leverage means which comprises the thick ends of said tapered supports and a tapered supports hinge means which is one of said hinge means connecting the thick ends of said tapered supports so that the axis of rotation of said hinge means is coplanar with each inner surface of said tapered supports; whereby the thick ends provide a lever action and begin prying outward against said endless belt as said closed loop is unfolded from a concave position to a convex position at the juncture of said tapered supports.

17. The invention of claim 16 wherein said brace means comprises:

(a) a brace section one half to one third as wide, about half as thick, and about three fourths as long as said tapered supports;

(b) a brace hinge means for connecting one end of said brace section to a position adjacent and parallel to the juncture of said tapered supports; whereby said brace section may rotate freely about an axis near the abutment of said tapered supports; and (c) an adjustable latch means for fixing the free end of said brace section against the inner surface of said base support in one of various positions; whereby said brace means may account for fluctuations in the size of said endless belt by holding said tapered supports unfolded the appropriate amount.

18. The invention of claim 17 wherein a triple hinge means, comprising said brace hinge means and said tapered supports hinge means, connects said brace section to the connection of said tapered supports.

19. The invention of claim 18 wherein said hinge means are pin hinges comprising a pivot pin which defines the rotational axis of said pin hinge.

20. The invention of claim 19 wherein said adjustable latch means is comprised of a series of parallel grooves formed into the inner surface of said base support, with each of said grooves designed to accept the free end of said brace section and hold it there when under tension from said endless belt.

* * * * *